United States Patent [19]

Frank

[11] 4,083,471

[45] Apr. 11, 1978

[54] RESEALABLE FRANGIBLE TOP FOR CONTAINERS

[75] Inventor: Howard A. Frank, Hoffman Estates, Ill.

[73] Assignee: Interfrange Ltd., Chicago, Ill.

[21] Appl. No.: 746,598

[22] Filed: Dec. 1, 1976

[51] Int. Cl.[2] ..... B65D 41/32

[52] U.S. Cl. ..... 220/269; 220/258; 229/7 R; 222/541

[58] Field of Search ..... 220/254, 258, 257, 269, 220/270, 268; 229/7 R; 222/541

[56] References Cited

U.S. PATENT DOCUMENTS

| | | | |
|---|---|---|---|
| 3,343,713 | 9/1967 | Fraze | 220/270 |
| 3,424,338 | 1/1969 | Kazel | 220/269 |
| 3,583,595 | 6/1971 | Eike | 220/270 |
| 3,730,380 | 5/1973 | Silver | 220/269 |
| 3,883,034 | 5/1975 | Ravsing | 220/269 |

*Primary Examiner*—George T. Hall

*Attorney, Agent, or Firm*—Charles A. Laff; J. Warren Whitesel; Howard B. Rockman

[57] ABSTRACT

A frangible top can has a top containing a laminated, two layer insert which comprises an upper plate containing a scored area and a lower plate having an opening. A depression, formed in the upper plate, fits snugly into the opening, which is formed in the lower plate. Thus, the depression may act as a stopper for the opening, when the can is resealed.

14 Claims, 17 Drawing Figures

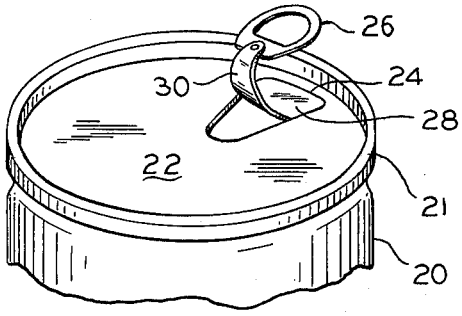
FIG.1
(PRIOR ART)
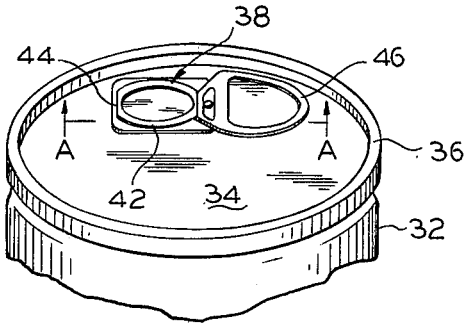
FIG.2
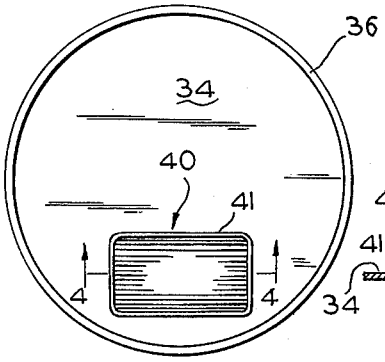
FIG.3
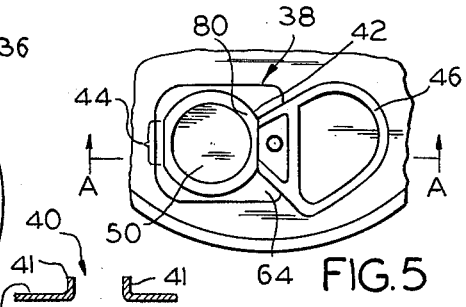
FIG.4
FIG.5
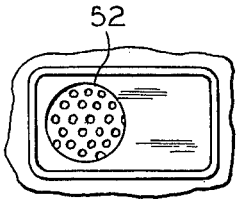
FIG.6
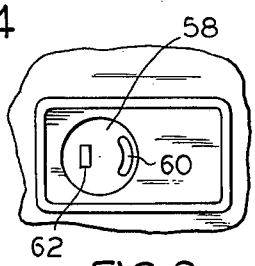
FIG.8
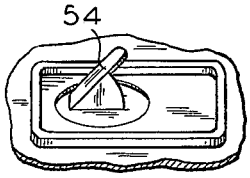
FIG.7
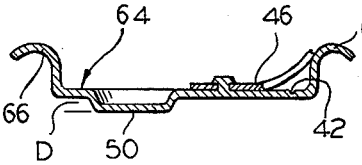
FIG.9
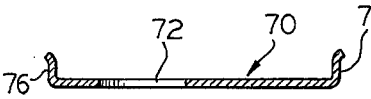
FIG.10
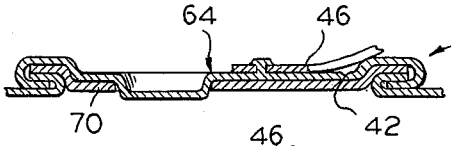
FIG.14
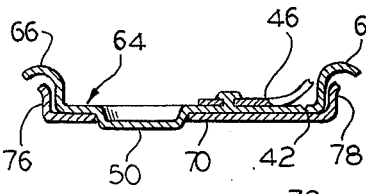
FIG.11
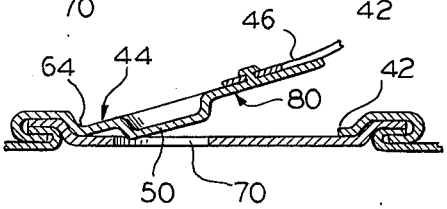
FIG.15
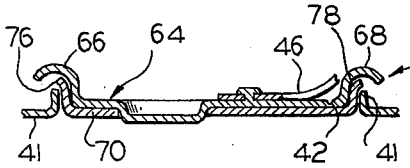
FIG.12
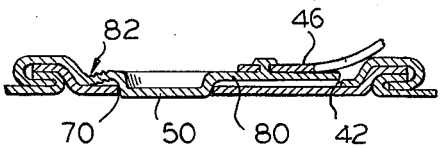
FIG.16
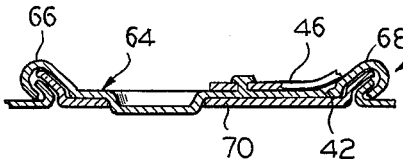
FIG.13
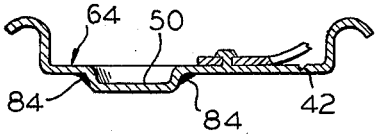
FIG.17

RESEALABLE FRANGIBLE TOP FOR CONTAINERS

This invention relates to frangible top containers and more particularly to resealable containers.

A tear top can is presently used as a container for beverages; however, it is not necessarily limited thereto. Many different, presently available forms of tear top cans are used for such diverse purposes as containing nuts, potato chips, or the like. In the future, there are likely to be many new and novel uses for tear top cans. Therefore, the invention is to be viewed as having many applications other than the present ones.

The characteristics of a tear top can are that a closed score line is embossed into the top to define an opening or tear area. A ring is firmly attached to the part of the can top which is circumscribed by the score line. When the ring is pulled, the can lid tears along the entire score line. The difficulties with this conventional form of can is that the part which is circumscribed by the score line becomes a completely separate part, which usually ends up as litter. After the can is opened, there is no easy way of resealing it.

Accordingly, an object is to provide a new and novel can top (hereinafter called a "resealable frangible top") which may be opened without requiring a special tool and which has resealing capabilities. Here, a further object is to provide a frangible can top which does not create separate parts that may become litter.

Another object is to provide a frangible top can having a plurality different forms of opening. Here, an object is to provide a shaker, pour spout, or other form of opening in combination with a resealable frangible top.

In keeping with an aspect of the invention, these and other objects are accomplished by a can having sealed therein a separate insert made from two layers. A first of the two layers comprises a plate having an opening therein, which opening may be adapted to contain any of many different forms of shakers, pour spouts, or the like. The other of the two layers includes a frangible top area. However, a score line does not completely circumscribe the entire frangible area. The unscored part functions as a hinge and also prevents the frangible part from being completely separated from the can. A part of the other layer is depressed to fit down into the opening of the first layer. The depressed part may act as a stopper on resealing.

The nature of a preferred embodiment of the invention may be understood best from a study of the attached drawings wherein:

FIG. 1 is a perspective view of a prior art tear top can;

FIG. 2 is a perspective view of an exemplary inventive frangible top can;

FIG. 3 is a plan view of the top of a can having therein an opening for receiving a frangible top insert;

FIG. 4 is a cross-sectional view of a fragment of the top, taken along line 4—4 of FIG. 3 and showing the contours thereof;

FIG. 5 is a plan view of the top of the can of FIG. 3 with the inventive frangible closure/reclosure element insert mounted therein;

FIG. 6 is a plan view of the inventive can with a shaker top;

FIG. 7 is a plan view of the inventive can with a pour spout;

FIG. 8 is a plan view of the inventive can with a rotatable closure plate; FIG. 9 is a cross-sectional view of an upper of two layers forming a laminated resealing insert;

FIG. 10 is a cross-sectional view of the lower of the two layer insert;

FIGS. 11–14 are a series of stop motion cross-sectional views showing how the two layer insert of FIGS. 8–9 are formed and then is sealed onto the can of FIGS. 2, 3, FIG. 14 showing the completed closure/reclosure element;

FIG. 15 is a similar cross-sectional view, with the top raised into an opened condition;

FIG. 16 is a similar cross-sectional view with the top closed and in a resealed condition; and FIG. 17 is a cross-sectional view which is similar to the view of FIG. 9, with a resealing gasket formed thereon.

The prior art, tear top can of FIG. 1 has a cylindrical side wall 20 terminated at the top in a circumferential Z-fold 21 sealing an end panel 22 thereto. A score line 24 circumscribes a tear area 28 on the top 22. A separate pull ring 26 is riveted to the tear area 28.

FIG. 1 illustrates three problems which are common to this prior art form of tear top can. First, the entire tear area 28 is circumscribed by scoring the line 24, so that a separate piece comes off the top, and that separate piece is likely to become separate, hard to pick up, litter. Second, once the tear area 28 is removed, the can is opened and cannot conveniently be resealed; therefore, the exposed contents of the opened can may quickly spoil. Third, the strip torn from the can tends to curl as at 30, so that it is almost impossible to flatten it again, without distortion of the metal.

The inventive can of FIG. 2 also includes a cylindrical wall 32 attached to a top 34 by a circumferential Z-fold 36. Here, there is a two layer insert assembly 38, which fits into a hole 40 (FIG. 3) formed in the top. The hole 40 is entirely surrounded by an upstanding wall 41, FIG. 4, drawn from the material of top 34.

The insert 38 includes a score line 42 which does not completely circumscribe the frangible area. The unscored part 44 forms a hinge area. A pull ring 46 is attached to the frangible area, as in FIG. 1. As best seen in FIG. 5, before the can is opened, the frangible area includes a depression 50 which acts as a stopper when the can is resealed. This depression is surrounded by vertical walls which keep a curl from forming as at 30, FIG. 1. Hence, the frangible area of an opened can still has a generally planar configuration so that it may fold down to again seal the can.

It should be noted that the prior art tear strip 28 presents an elongated opening extending radially across the top of the can while the inventive frangible strip extends parallel to a diagonal of the can top.

When the inventive can is opened, the underlying layer of the two layer insert contains a hole which may have any of many different configurations. For example, FIG. 6 shows a shaker top 52, FIG. 7 shows a pour spout 54, and FIG. 8 shows a turn top. The pour spout may raise or lower, somewhat similar to the pour spout on a salt or powdered soap box, for example. The turn top 58 has a large opening 60 and thumb catch 62, somewhat similar to a device commonly found on the top of a spice can, for example. Still other devices may be placed in the opening of the lower layer.

It is thought that the construction and nature of the invention may be understood best from a step-by-step description of the manufacture of the inventive can, with the aid of FIGS. 9–17, each of which is a cross section of the closure means, taken along line A—A of FIGS. 2 and 5.

FIG. 9 shows the upper layer of the inventive two layer laminated insert. As here shown, there is a generally rectangular plate 64 terminated around its entire perimeter by a partially formed lip, as shown at 66, 68. A central depression 50 is pressed downwardly in the form and shape of the opening which is to be resealed. The depression has a continuous side wall with a depth D, which forms a vertical beam of substantial strength, so that the frangible top does not curl, as seen at 30 (FIG. 1) when the can is opened. Thus, the invention does not face this distortion of the frangible strip problem, which is common to the prior art which used tear strips. A score line at 42 weakens the insert so that plate 64 will rupture when pull ring 46 is lifted.

A second plate 70 (FIG. 10) of the insert has a hole or opening 72 formed therein. The area and geometry of opening 72 conforms to the area and geometry of the depression 50. Therefore, depression 50 acts as stopper for closing the opening 72. If any of the structures of FIGS. 6–8 are placed in the insert plate 70, they are put in at this time and are placed low enough in the bottom of the opening 72 so that they will not interfere with the assembly of the insert. The periphery of the plate 70 terminates in an upstanding wall, as shown at 76, 78. The contours of wall 76, 78 fit snugly inside lip 66, 68.

The two layer insert is made (FIG. 11) by fitting the upper plate 64 over the lower plate 70, with the depression 50 fitting down into the hole 72, thereby forming a two layer laminate. Next, the laminate is placed (FIG. 12) on the can top 34 (FIG. 3) with the upper plate lip 66, 68 fitting over the upstanding wall 41 (FIG. 4) previously formed on the top. The wall 76, 78 of the lower insert plate 64 is interposed between upper plate lip 66, 68 and can top wall 41. Thereafter, the upper plate lip 66, 68 is rolled (FIG. 13) over the other two walls 41, 76, 78 and then flattened (FIG. 14) into the well known Z-fold. FIG. 14 shows the closure/reclosure element in its completed form. The Z-fold forms a leak-proof seam between can top 34 and the periphery of the insert 38. The score line 42 remains unbroken at the time of this assembly.

To open the can (FIG. 15), the pull ring 46 is pulled. The score line 42 ruptures and the area 80, which is almost, but not completely, encompassed by the score line, tends to break away from the upper plate 64 without becoming fully separated therefrom. The depressed area 50 is pulled from the hole 70. The unscored area 44 acts as a hinge for the ruptured area. Any contents of a can, having the now opened top of FIG. 15, may be poured through opening 70 and any of the devices may be used with the inventive can, such as those of FIGS. 6–8.

If it is necessary or desirable to reclose the can (FIG. 16) the ruptured area 80 is pressed back over the top of the can. The depressed area 50 in the upper plate fits again into the hole 70 of the lower plate, acting as a stopper. The vertical strength of the depression side wall (dimension D) has preserved the planar integrity of the torn area 80 so that it fits well when the can is reclosed. It is possible that the hinge area may have become slightly distorted, as at 82. However, this minor distortion is not so great that it interferes with reclosure during the life time of the hinge (i.e., until the can is emptied of its contents).

FIG. 17 is substantially the same as FIG. 9; however, it shows how the upper plate 64 may have a layer of rubber cement 84, 84, or the like, painted around the edges of the depressed region 50 in order to form a gasket area which facilitates resealing. This form of gasket may also be used in conjunction with any of the other seals, such as under lip 66, 68 as may be required. Of course, other forms of gaskets, such as cork or rubber rings, may also be used.

Those who are skilled in the art will readily perceive how changes and modifications may be made in the inventive structure. Therefore, the appended claims are to be construed broadly enough to cover all equivalent structures falling within the scope and the spirit of the invention.

We claim:

1. A resealable frangible top container comprising an insert having two layers, one of said layers being an upper plate with a score line and a depressed region formed therein, said score line incompletely encompassing an area including said depressed region so that one section of said score line does not rupture and so that the non-ruptured section may act as a hinge when the top is open, the second of said layers being a lower plate with an opening, said depressed region in the upper plate and said opening in said lower plate having substantially the same area and contours so that said depression in the upper plate acts as a stopper for the hole in the lower plate, said upper and lower plate being joined around their periphery to form said insert, and means formed on the top of said can and shaped to surround the periphery of said insert for sealing it to a can top.

2. The resealable container of claim 1 wherein said peripheral sealing means comprises a Z-fold.

3. The resealable container of claim 1 and a pull ring attached to the area on a side of said depressed region which is opposite said incompletely encompassing part of said score line.

4. The resealable container of claim 1 and a pour structure formed in said opening in said lower plate.

5. The resealable container of claim 4 wherein said pour structure is a multiopening shaker.

6. The resealable container of claim 4 wherein said pour structure of a foldable spout.

7. The resealable container of claim 4 wherein said pour structure includes a rotatable plate.

8. The resealable container of claim 1 wherein said depressed region is surrounded with a gasket.

9. The resealable container of claim 1 wherein said score line and opening extend parallel to a diagonal of the can top when said insert is sealed to said top of said can.

10. A resealable can having a top with a predetermined surface area, said can comprising:

a. an upper plate with an area which is much smaller than said predetermined surface area, said upper plate having a peripheral lip, a depressed region, and a score line almost completely encompassing the depression;

b. a lower plate with an upstanding peripheral wall fitting the peripheral lip of said upper plate and a hole shaped and positioned so that said depression acts as a stopper for said hole;

c. a can top with an opening which is equal and complementary to said area that is much smaller than the area of the can top and which has an upstanding peripheral wall fitting said lip; and d. said lip being rolled to capture and seal said two upstanding walls in a sealing closure.

11. The can of claim 10 wherein part (a) includes a pull ring on the area almost completely encompassed by said score line, the point of pull ring attachment being opposite the incomplete section of said score line.

12. The can of claim 11 wherein part (b) includes a pouring device in said opening.

13. The can of claim 12 wherein part (a) includes a gasket around said depressed region.

14. The can of claim 12 wherein part (a) includes said upper plate positioned to lie parallel to a diagonal of the can top.

* * * * *